US010760751B1

(12) United States Patent
Bowen

(10) Patent No.: US 10,760,751 B1
(45) Date of Patent: Sep. 1, 2020

(54) CONFIGURABLE MOUNTING FRAME FOR DIRECT MOUNT LUMINAIRES

(71) Applicant: SIGNIFY HOLDING B.V., Eindhoven (NL)

(72) Inventor: John E. Bowen, Sharpsburg, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/290,437

(22) Filed: Mar. 1, 2019

(51) Int. Cl.
*F21S 8/00* (2006.01)
*F21V 23/00* (2015.01)
*F21V 21/03* (2006.01)

(52) U.S. Cl.
CPC ..... *F21S 8/03* (2013.01); *F21V 21/03* (2013.01); *F21V 23/007* (2013.01)

(58) Field of Classification Search
CPC ..... F21S 8/03; F21V 23/007; F21V 21/03
See application file for complete search history.

(56) References Cited

U.S. PATENT DOCUMENTS 4,149,226 A * 4/1979 Dalton ..... F21V 19/0075 362/216
2009/0284168 A1* 11/2009 Yang ..... H05B 41/02 315/291
2019/0346098 A1* 11/2019 Lawrence ..... F21S 8/043

* cited by examiner

*Primary Examiner* — Donald L Raleigh

(57) ABSTRACT

A configurable mounting frame includes a light fixture receiving opening having a first shape. The light fixture receiving opening is configured to receive a light fixture to mount the light fixture to a mounting surface. Further, the configurable mounting frame includes breakaway panels that are detachable to change the shape of the light fixture receiving opening from the first shape to a second shape that is different from the first shape. Furthermore, the configurable mounting frame includes locking features that are configured to toollessly and releasably lock an electrical or electronic component such as a junction box-driver assembly thereto.

16 Claims, 13 Drawing Sheets

CONFIGURABLE MOUNTING FRAME FOR DIRECT MOUNT LUMINAIRES

TECHNICAL FIELD

Embodiments of the present disclosure relate generally to mounting structures, and more particularly to a configurable mounting frame for mounting direct mount luminaires in a ceiling or a similar mounting surface.

BACKGROUND

Direct mount luminaires are recessed lighting units that are installed in mounting surfaces such as drywall ceilings or suspended ceilings without a recessed housing can. Typically, the recessed lighting units are mounted in the ceiling using a mounting frame (also known as 'plaster frame') that is disposed behind the ceiling, e.g., in the plenum between the structural ceiling (roof) and a finished ceiling wall that conceals the underside of the structural ceiling. The mounting frame may be secured directly to the joists in the ceiling or supported on hanger bars that are fastened to and extend between the joists. Further, the mounting frame includes a light fixture receiving opening that is configured to receive the recessed lighting unit and secure the recessed lighting fixture to the mounting frame. In some instances, the light fixture receiving opening in the mounting frame may also be used as a guide along which an aperture can be cut in the ceiling for installing the recessed lighting unit.

In conventional mounting frames, the shape of the light fixture receiving opening in the mounting frame may be fixed and may depend on the shape of the recessed lighting unit that is to be mounted to the mounting frame. That is, in conventional mounting frames, the shape of the light fixture receiving opening may be configured to allow a similarly shaped lighting unit to be received and mounted to the mounting frame. For example, a mounting frame with a circular light fixture receiving opening may be configured to receive and mount a lighting unit having a substantially circular shape. However, if a different lighting unit having a shape that is different from the shape of the light fixture receiving opening of the mounting frame is to be mounted, a different mounting frame with a light fixture receiving opening having a shape corresponding to or substantially similar to that of the different lighting unit will be required. In other words, to accommodate various lighting units of different shapes, several mounting frames are required, where each mounting frame has a light fixture receiving opening of a different shape.

The requirement for several different mounting frames imposes the need for the luminaire manufacturer to produce, and the luminaire dealers to manage increased product stock keeping units (SKUs). Additionally, in a remodel installation scenario where a user wants to replace a lighting unit having a first shape with a new lighting unit having a different second shape, the existing mounting frame having a light fixture receiving opening that is only configured to receive the lighting unit having the first shape will have to be removed and replaced with a different mounting frame having a light fixture receiving opening that is configured to receive the lighting unit having the second shape. The removal and replacement of the existing plaster frame with another plaster frame may be both labor and time intensive.

Further, in conventional mounting systems, junction boxes associated with a luminaire have to be attached to the mounting frames prior to installing the mounting frames in the ceiling. That is, in conventional mounting systems, the mounting frame and the junction box that is attached thereto are installed as a single unit in the ceiling because conventional mounting frames are not configured to allow the junction box to be separately coupled thereto or securely disposed thereon after the mounting frames have been installed in the finished ceiling.

Furthermore, in conventional systems, the junction boxes are attached to the mounting frames using fasteners which require the installer to use tools, such as screw drivers or other appropriate fastening tools. That is, the conventional mounting frames are not configured to allow a toolless mounting, coupling, or installation of the junction boxes and/or any other electrical and electronics components (e.g., drivers) thereto.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to a configurable mounting frame that includes a base. The base includes a light fixture receiving opening formed therein. The light fixture receiving opening having a first shape and configured to receive a first light fixture. A shape of the first light fixture corresponds to the first shape of the light fixture receiving opening. Further, the base includes a breakaway panel disposed adjacent to the light fixture receiving opening. The breakaway panel being detachable from the base to change the light fixture receiving opening from the first shape to a second shape. The light fixture receiving opening having the second shape is configured to receive a second light fixture. The shape of the second light fixture corresponds to the second shape of the light fixture receiving opening. Furthermore, the base includes a locking feature configured to releasably lock an electrical component to the configurable mounting frame. Further, the configurable mounting frame includes a side wall that extends substantially perpendicular to the base from a perimeter of the base. The locking feature is disposed on the base between the side wall and the light fixture receiving opening.

In another aspect, the present disclosure relates to a configurable mounting frame. The configurable mounting frame includes a base that comprises a light fixture receiving opening formed therein. The light fixture receiving opening has a first shape and is configured to receive a first light fixture, where a shape of the first light fixture is substantially similar to the first shape of the light fixture receiving opening. Further, the base includes a breakaway panel disposed adjacent to the light fixture receiving opening. The breakaway panel is detachable from the base to change the light fixture receiving opening from the first shape to a second shape. The light fixture receiving opening having the second shape is configured to receive a second light fixture, where a shape of the second light fixture is substantially similar to the second shape of the light fixture receiving opening.

In yet another aspect, the present disclosure relates to a configurable mounting frame that includes a base. The base includes a light fixture receiving opening formed therein. The light fixture receiving opening having a first shape and configured to receive a first light fixture, where a shape of the first light fixture is substantially similar to the first shape of the light fixture receiving opening. Further, the base includes a locking feature that is configured to releasably lock an electrical component to the configurable mounting frame. The configurable mounting frame includes a side wall that extend substantially perpendicular to the base from a perimeter of the base. The locking feature is disposed on the base between the side wall and the light fixture receiving opening.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
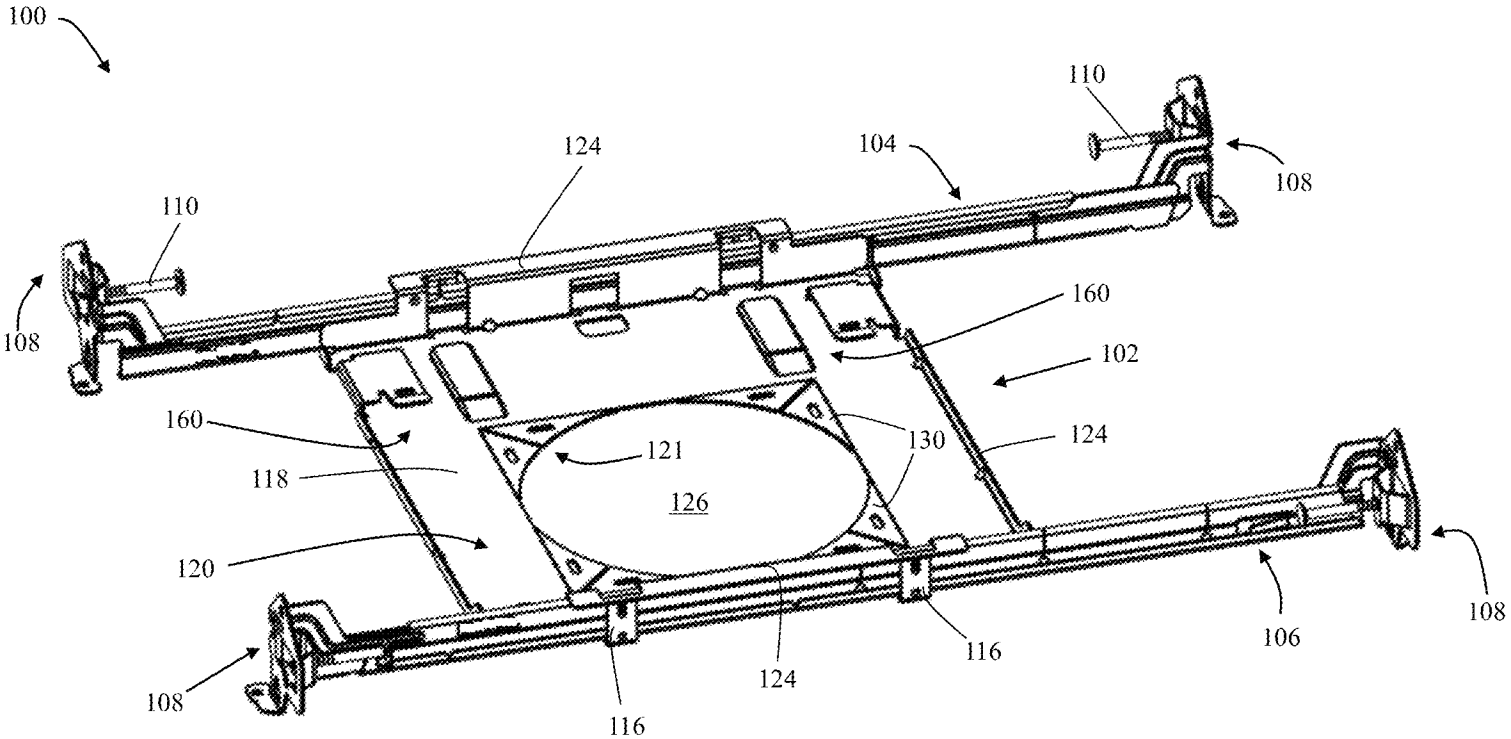
FIG. 1 illustrates a perspective view of an example luminaire mounting assembly, in accordance with example embodiments of the present disclosure.
Figure 2:
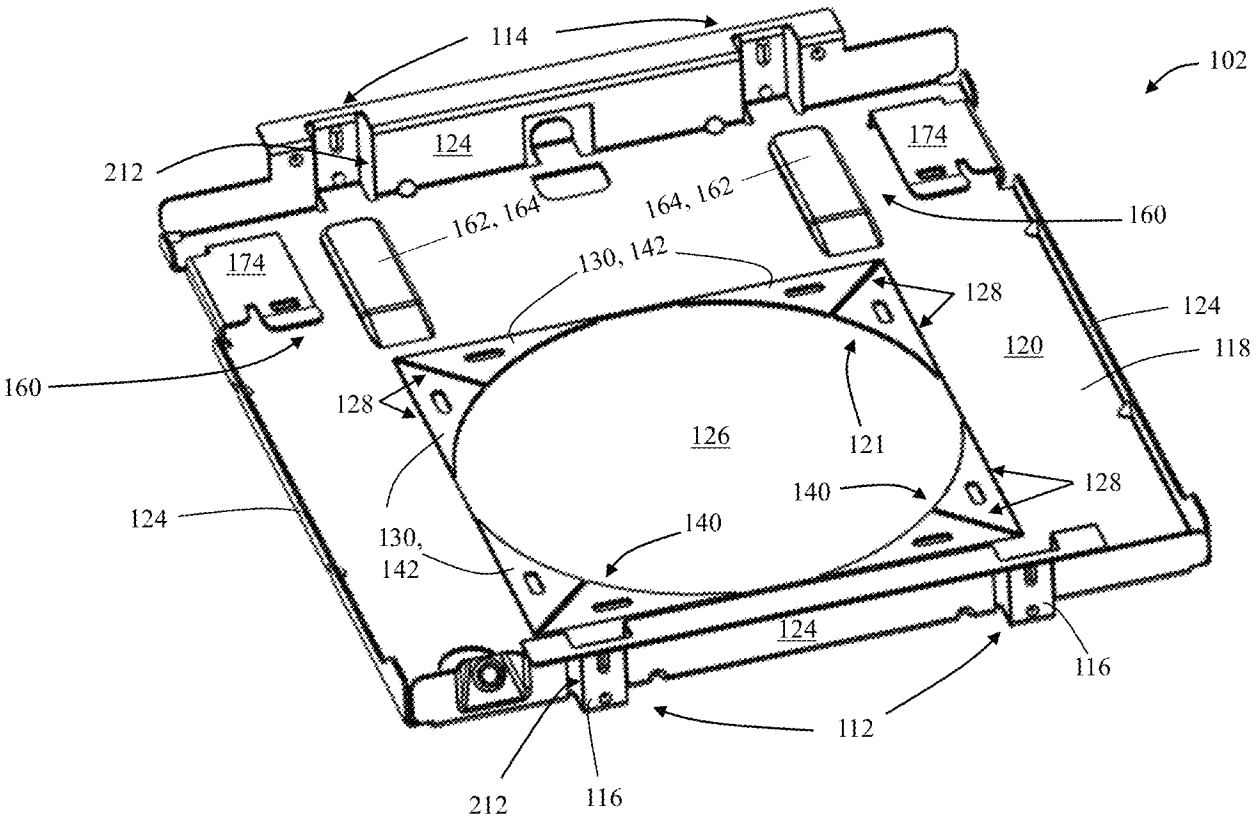
FIG. 2 illustrates a top perspective view of an example configurable mounting frame of the luminaire mounting assembly of FIG. 1, in accordance with example embodiments of the present disclosure.
Figure 3:
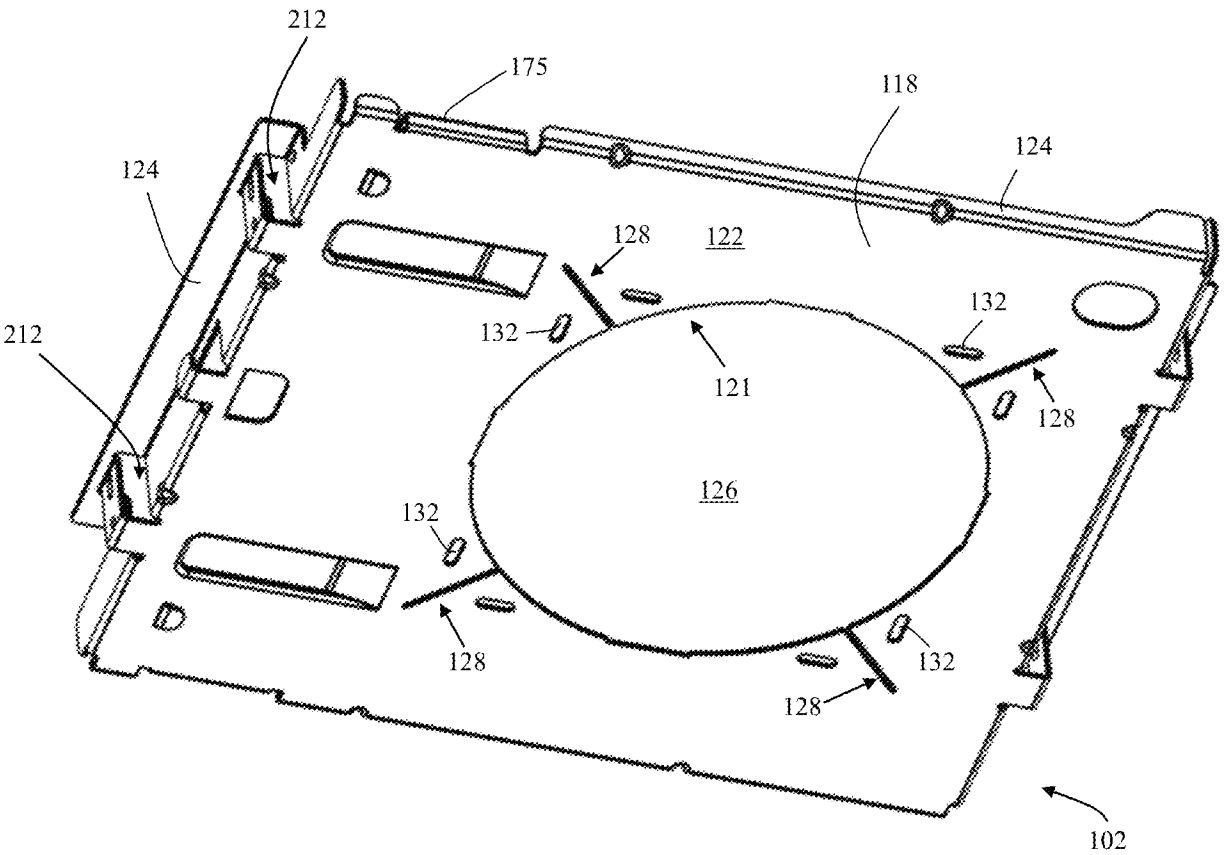
FIG. 3 illustrates a bottom perspective view of the example configurable mounting frame, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

In the following paragraphs, a configurable mounting frame for direct mount luminaires will be described in further detail by way of examples with reference to the attached drawings. In the description, well-known components, methods, and/or processing techniques are omitted or are briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s). Even though the present disclosure describes the configurable mounting frame as being configured for mounting direct mount luminaires, one of skill in the art can understand and appreciate that the configurable mounting frame can be used for mounting any other appropriate luminaire, e.g., recessed luminaires mounted in recessed housing cans, without departing from a broader scope of the present disclosure.

The configurable mounting frame of the present disclosure includes a light fixture receiving opening that is configurable to accommodate lighting units of different shapes therein, thereby allowing lighting units of different shapes to be mounted using the same mounting frame. In one example, the configurable mounting frame includes breakaway panels that are configured to be detached from the mounting frame to change a shape of the light fixture receiving opening from a first shape that is configured to accommodate a lighting unit having a first shape to a second shape that is configured to accommodate a lighting unit having the second shape. In so doing, the configurable mounting frame allows a lighting unit having a first shape or a lighting unit having a second shape to be mounted using the same configurable mounting frame (i.e., without having to use two different mounting frames as in conventional mounting systems).

Further, the configurable mounting frame of the present disclosure includes locking features that are configured to allow a junction box assembly, a driver assembly, and/or a junction box-driver assembly to be removably coupled thereto without the use of any tools (toollessly). The ability to toollessly couple the junction box assembly, the driver assembly, and/or the junction box-driver assembly to the configurable mounting frame allows the junction box assembly, the driver assembly, and/or the junction box-driver assembly to be coupled to the configurable mounting frame after the configurable mount frame has been installed in the finished ceiling in new construction installations or remodel installations.

Even though the figures of the present disclosure illustrate and the following description describes the configurable mounting frame of the present disclosure as having both the locking feature and the configurable light fixture receiving opening feature, one of skill in the art can understand and appreciate that in some example embodiments, the configurable mounting frame of the present disclosure may not include both the locking features and the configurable light fixture receiving opening. Instead, the configurable mounting frame may include only one of the features. That is, in some example embodiments, the configurable mounting frame may include either the locking features or the configurable light fixture receiving opening without departing from a broader scope of the present disclosure.

Moving now to discuss the figures, FIGS. 1-13 will describe one or more example embodiments of a configurable mounting frame. Referring to FIGS. 1-13, an example mounting assembly 100 may include an example configurable mounting frame 102 and a pair of hanger bar assemblies (104, 106) that are removably coupled to configurable mounting frame 102 (herein 'frame').

The hanger bar assemblies 104 and 106 may be disposed on opposite sides of the frame 102 and may be configured to dispose the frame 102 above a mounting surface, such as a ceiling. The hanger bar assemblies 104 and 106 may be adjustable in length to attach the frame 102 and thereby luminaires mounted thereon, such as direct mount luminaires, to support structures in the ceiling that have different spacing between them. Each hanger bar assembly (104, 106) may include attachment members 108 on opposite ends of the hanger bar assembly (104, 106) that are configured to secure the hanger bar assembly (104, 106) to a support structure in the ceiling, such as parallel joists, suspended ceiling T-grids, and/or steel framing, using respective fasteners 110 (e.g., a screw or nail).

The frame 102 may include pairs of attachment tabs (112, 114) disposed on opposite sides of the frame 102. Each attachment tab 116 of the pairs of attachment tabs (112, 114) may define a hanger bar receiving slot 212 that is configured to receive a hanger bar assembly (104 or 106). Each hanger bar assembly (104, 106) may be received through hanger bar receiving slots 212 defined by a respective pair of attachment tabs (112, 114) such that the frame 102 is supported on opposite sides by the hanger bar assemblies (104, 106) as illustrated in FIG. 1. In some example embodiments, the attachment tabs 116 may be integrally formed with the frame 102, for example, by a side wall 124 of the frame 102 as illustrated in FIGS. 1-10 and 12-13. However, in other example embodiments, the attachment tabs 116 may be removably coupled to or attached to the frame 102, for example, by soldering or using fasteners. In some example embodiments, the attachment tabs 116 may be elastic and adjustable or movable along the frame 102.

In addition to the attachment tabs 116, the frame 102 may include a base 118 that has a first surface 120 and a second surface 122 that is disposed opposite to the first surface 122. Further, the frame 102 may include side walls 124 that extend substantially perpendicular to the base 118 along a perimeter of the base 118. In one example embodiment, the base 118 may be substantially square shaped, however, in other example embodiments, the base 118 may have any other appropriate shape without departing from a broader scope of the present disclosure. Further, in some example embodiments, the side walls 124 may be offset from the perimeter and/or may extend at a different angle to the base 118 without departing from a broader scope of the present disclosure.

The base 118 may include a light fixture receiving opening 126 (herein 'fixture receiving opening') that is formed therein. The fixture receiving opening 126 may be configured to receive a direct mount luminaire (1302, 1304, etc.) (herein 'luminaire') to mount the luminaire to the frame 102 (shown in FIG. 13). The fixture receiving opening 126 may be a through opening that extends from the first surface 120 of the base 118 through the second surface 122. It should be understood that the luminaire can extend through the fixture receiving opening 126 or the luminaire may be attached to the frame such that the luminaire is disposed at or slightly above the fixture receiving opening 126. As illustrated in FIGS. 1-5 and 12-13, the fixture receiving opening 126 may be disposed between the side walls 124 and may have a first shape. The first shape may include, but is not limited to, a circle, a square, a rectangle, an oval, or any other appropriate shape.

Further, the base 118 may include breakaway panels 130 formed therein. The breakway panels 130 may be disposed adjacent to and along at least a portion of an aperture edge 121 that defines a perimeter of the fixture receiving opening 126. In the example embodiment illustrated in FIGS. 1-10 and 12-13, the breakaway panels 130 may be marked (or outlined) by slits 128 formed in the base 118. In other example embodiments, the breakaway panels 130 may be marked using any other appropriate mechanism. For example, in some embodiments, the breakaway panels 130 may be marked by perforated lines or score lines. In either case, each breakaway panel 130 may be detachable from the base 118 along the slits 128 that mark the respective breakaway panel 130.

Each breakaway panel 130 may include at least one pry out slot 132 formed therein. The pry out 132 slot may be configured to receive a leverage tool therein to aid or provide leverage to a user to detach the breakaway panels 130 from the base 118. For example, a user may insert the head of a screwdriver into and/or through the pry out slot 132 of a breakaway panel 130 and use the screwdriver to push and pry out the breakaway panel 130. Alternatively, a user may detach the breakaway panel 130 from the base 118 by tearing and/or breaking (snapping) the breakaway panel 130 along the slits 128 using the user's fingers. Accordingly, in some example embodiments, the breakaway panel 130 may not include the pry out slot 132.

The breakaway panels 130 are configured to be detached from the base 118 to change the shape of fixture receiving opening 126 from a first shape that is configured to receive therein a luminaire having a first shape (or substantially a first shape) to a second shape that is configured to receive therein a luminaire having a second shape (or substantially a second shape). That is, the breakaway panels 130 allow the same frame 102 to be used for mounting luminaires having different shapes by detaching the breakaway panels 130 from the base 118 to change the shape of the fixture receiving opening 126 from a first shape to a second shape. The second shape may be different from the first shape and may include, but is not limited to, a circle, a square, a rectangle, an oval, or any other appropriate shape.

Figure 8:
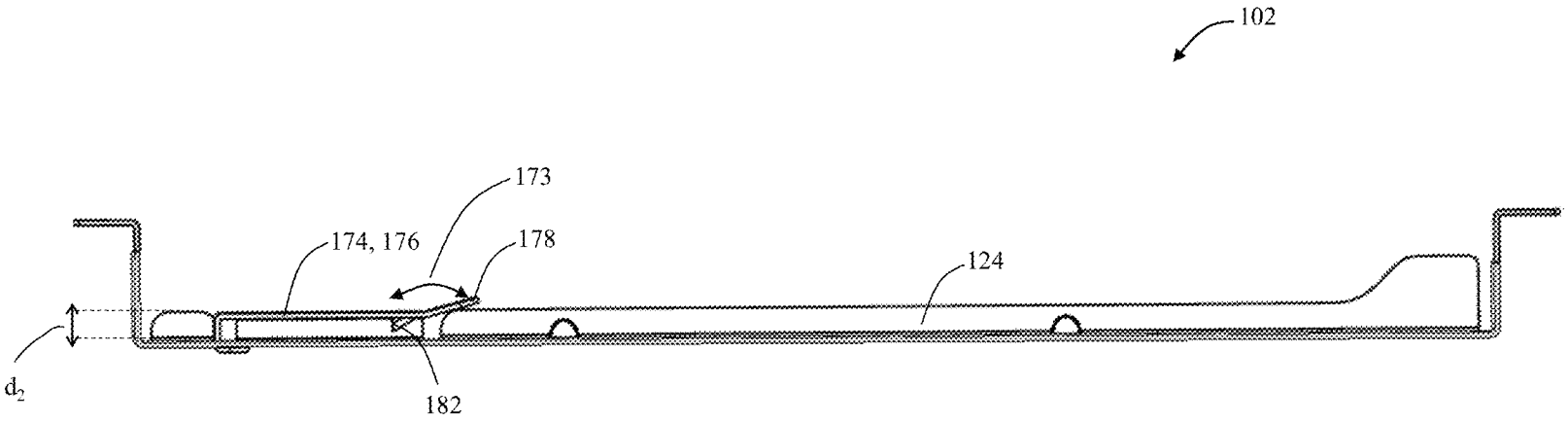
FIG. 8 illustrates a second cross-sectional view of the example configurable mounting frame along an X"-X'" axis, in accordance with example embodiments of the present disclosure.
Figure 9:
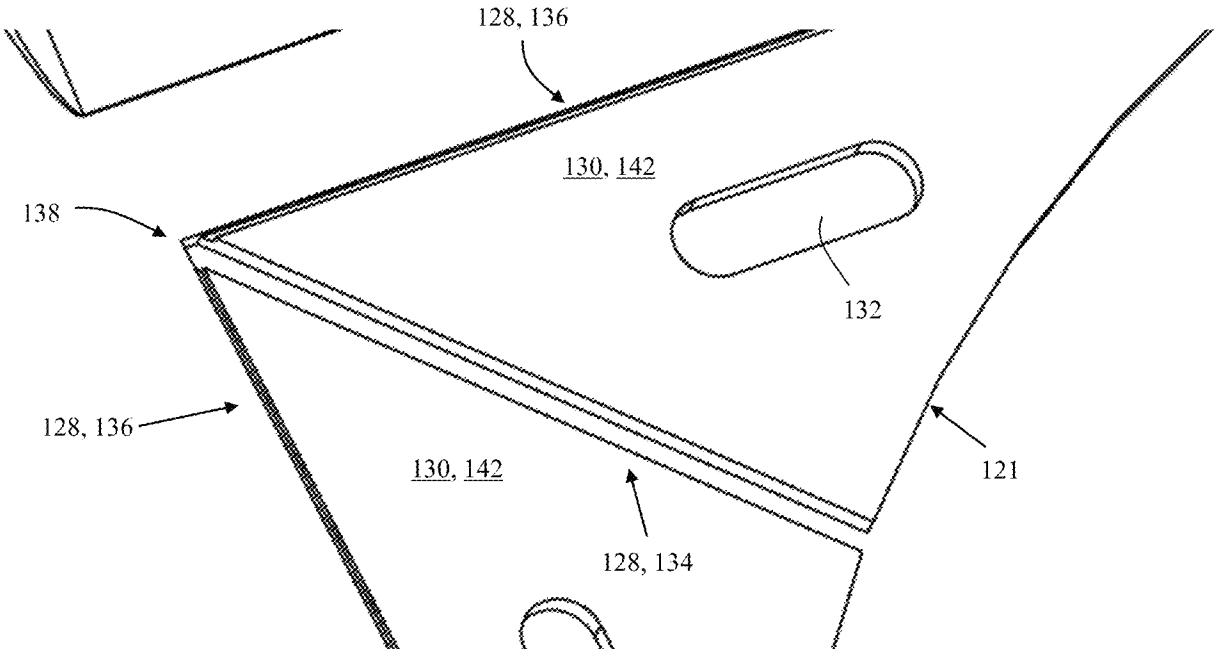
FIG. 9 is another enlarged view of another portion of the example configurable mounting frame illustrating example detachable panels of the example configurable mounting frame, in accordance with example embodiments of the present disclosure.
Figure 10:
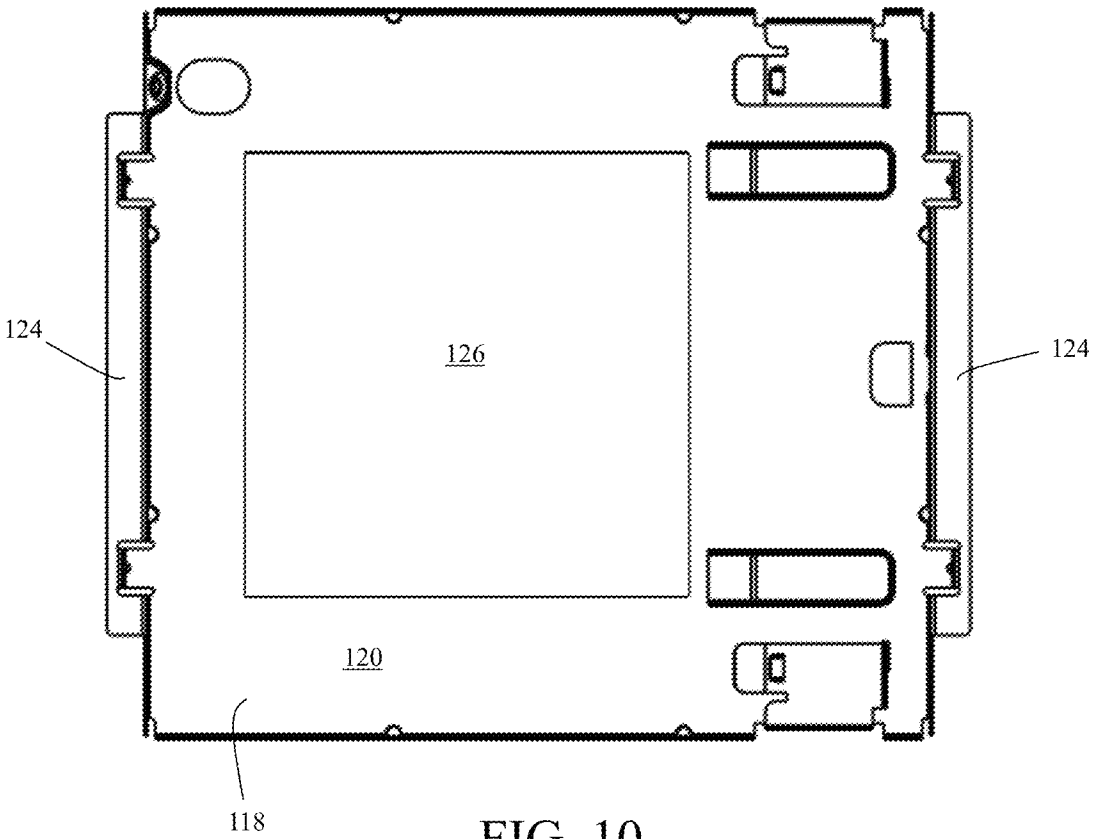
FIG. 10 illustrates a top view of the configurable mounting frame with the detachable panels removed therefrom, in accordance with example embodiments of the present disclosure.

In the example embodiment illustrated in FIGS. 1-9 and 12-13, the fixture receiving opening 126 of the frame 102 may be a substantially circular opening, and the breakaway panels 130 may be configured such that when they are detached from the base 118, the fixture receiving opening 126 changes to a substantially square shaped opening as illustrated in FIG. 10. The substantially circular fixture receiving opening 126 as illustrated in FIGS. 1-9 and 12-13 may be configured to receive and mount a luminaire with a corresponding shape (e.g., a substantially circular luminaire) 1302 (shown in FIG. 13) to the frame 102, while the substantially square shaped fixture receiving opening 126 as illustrated in FIG. 10 may be configured to receive and mount a luminaire with a corresponding shape (e.g., a substantially square shaped luminaire) 1304. That is, in the example embodiment illustrated in FIGS. 1-10 and 12-13, the breakaway panels 130 allow the same frame 102 to be used to mount a luminaire having a substantially circular profile or a luminaire having a substantially square profile thereto unlike conventional mounting systems that require two different frames having fixture receiving openings of two different shapes for mounting luminaires of two different shapes.

Figure 4:
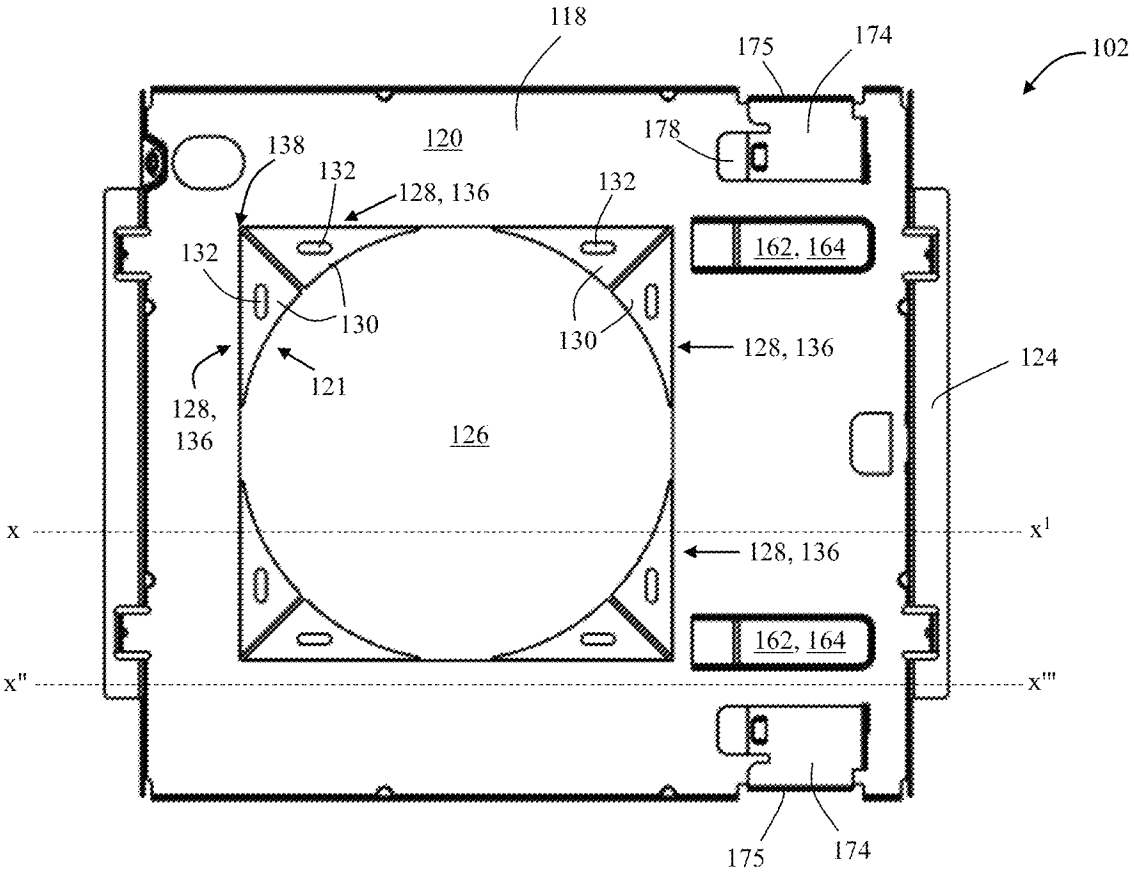
FIG. 4 illustrates a top view of the example configurable mounting frame, in accordance with example embodiments of the present disclosure.
Figure 5:
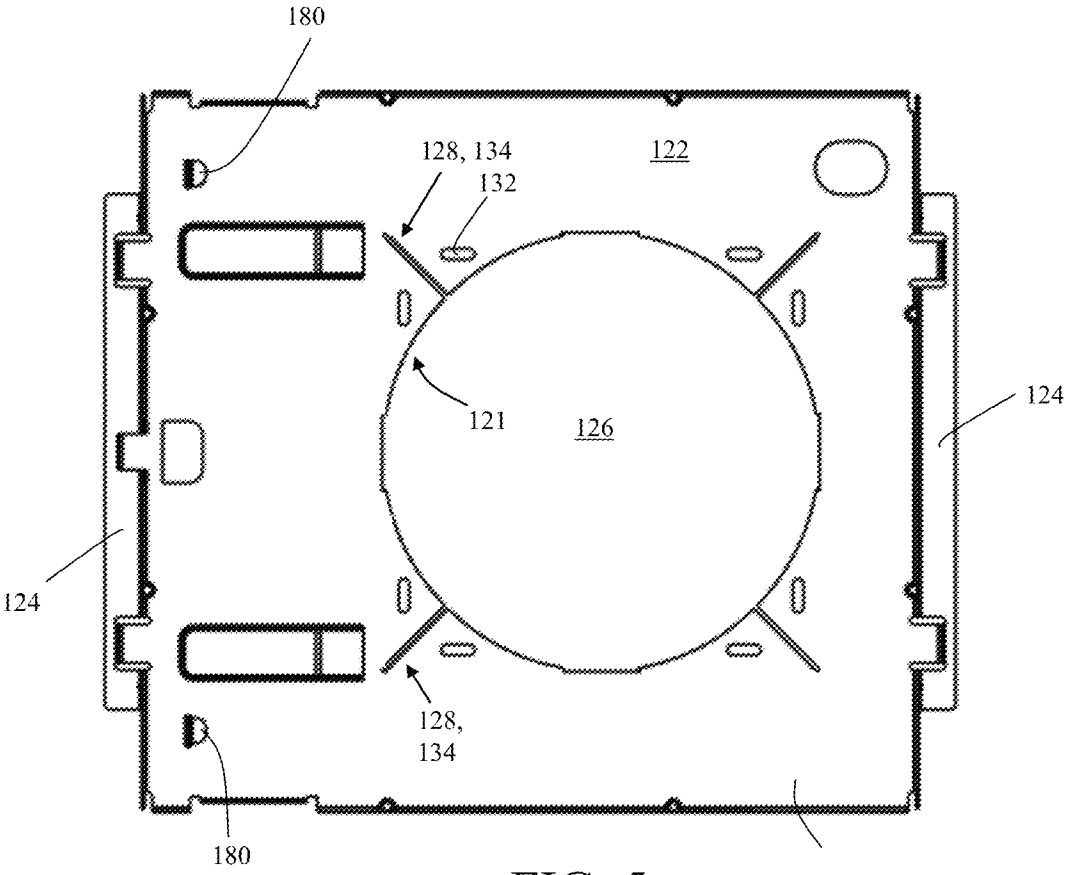
FIG. 5 illustrates a bottom view of the example configurable mounting frame, in accordance with example embodiments of the present disclosure.
Figure 7:
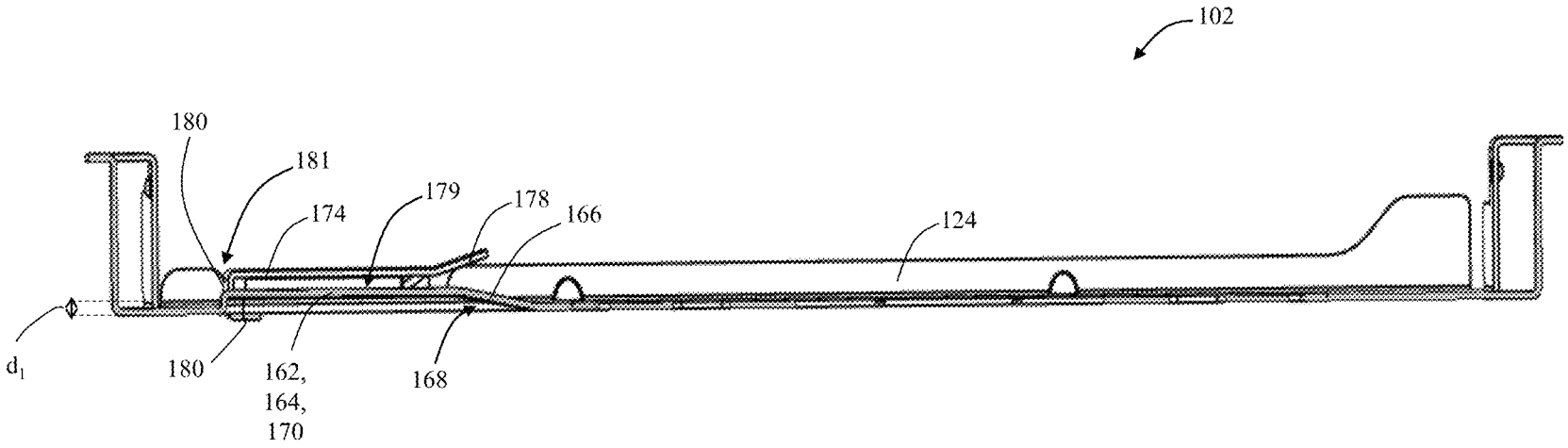
FIG. 7 illustrates a first cross-sectional view of the example configurable mounting frame along an X-X' axis, in accordance with example embodiments of the present disclosure.

In particular, in the example embodiment illustrated in FIGS. 1-10 and 12-13, the slits 128 that define and/or outline the breakaway panels 130 may include a first set of slits 134 and a second set of slits 136 (shown in FIGS. 4, 5, and 9). The first set of slits 134 may extend radially outward from the aperture edge 126 that defines a perimeter of the fixture receiving opening 122 towards the side walls 124. The first set of slits 134 may be through slits that extend from the first surface 120 through the second surface 122 of the base 118. Further, the second set of slits 136 may extend from the tip 138 of each first slit 134 towards the aperture edge 121 such that they are either substantially parallel to or perpendicular to the side walls 124 or edges of the base 118 that define a perimeter of the base 118. The second set of slits 136 may extend from the first surface 120 of the base 118 towards the second surface 122 but may not extend through the base 118. In some example embodiments, both the first set of slits 134 and the second set of slits 136 may not extend through the base 118 so that the second surface 122 of the frame 118 has a smooth and pleasing appearance (with no visible slots).

Furthermore, in the example embodiment illustrated in FIGS. 1-10 and 12-13, the breakaway panels 130 may be configured as four large breakaway panels 140 disposed around at least a portion of the perimeter of the fixture receiving opening 126 and defined by the second set of slits 136, where each large breakaway panels 140 may be further divided into two smaller breakaway panels 142 by the first set of slits 134.

Even though the present disclosure describes the breakaway panels as being defined by slits, one of skill in the art can understand and appreciate that in other example embodiments, the breakaway panels may be outlined or defined by any other appropriate mechanism without departing from a broader scope of the present disclosure. For example, in some embodiments, the breakaway panels may be defined by perforated lines. Further, in other example embodiments, the base of the frame may include fewer or more slits and/or breakaway panels without departing from a broader scope of the present disclosure. Furthermore, in other example embodiments, the breakaway panels may be configured to create fixture receiving openings of any appropriate shape and is not limited to changing the shape of the fixture receiving opening from a circular shape to a square shape.

Even though the present disclosure illustrates and describes the fixture receiving opening as initially being a circular opening, one or skill in the art can understand and appreciate that in other example embodiments, the fixture receiving opening may initially be any other appropriate shape, e.g., square, rectangular, etc., and the breakaway panels may be configured to change the shape of the fixture receiving opening to any another appropriate shape, e.g., circle, oval, etc., without departing from a broader scope of the present disclosure. Further, even though the present disclosure describes the breakaway panels as being configured to change the shape of the fixture receiving opening from a first shape to a second shape, one of skill in the art can understand and appreciate that in other example embodiments, the breakaway panels may be configured such that the shape of the fixture receiving openings in the base of the frame can be changed from a first shape to a second shape and then to a third shape and so on by selectively detaching the breakaway panels from the base without departing from a broader scope pf the present disclosure. That is, in other example embodiments, the breakaway panels may be configured to progressively change the shape of the fixture receiving opening from a first shape to N-number of different shapes without departing from a broader scope of the present disclosure.

As illustrated in FIGS. 1-8, 10, and 12-13, the frame 102 may further include locking features 160 that are configured to secure and removably couple an electrical and/or electronic component such as a junction box assembly, a driver assembly, junction box-driver assembly 1102 (shown in FIG. 11), etc., thereto without the use of any tools. Further, the locking features 160 of the frame 102 allow the electrical and/or electronic component to be coupled thereto through the fixture receiving opening 126 of a frame 102 that has been installed in a finished ceiling or any appropriate mounting surface, e.g., in a new construction installation, or the frame 102 that is already installed in the ceiling, e.g., in a remodel installation. In other words, the locking features 160 of the frame 102 allow a user to toollessly couple, mount, or install an electrical and/or electronic component thereto post installation of the frame 102 in a mounting surface (e.g., ceiling) in a new construction or remodel application.

The locking features 160 may include mounting pads 162 that are formed on the base 118 of the frame 102. The mounting pads 162 may be integral with the base 118 and defined by a raised portion 164 of the base 118 that is embossed or stamped into the base 118. The mounting pads 162 may be disposed between the fixture receiving opening 126 and the side walls 124 as illustrated in FIGS. 1-8, 10, and 12-13. In particular, each mounting pad 162 may include a ramp segment 166 that extends angularly from the base 118 such that it forms an obtuse external angle 168 with the base 118. Further, the mounting pad 162 may include a flat segment 170 that extends from a top edge 172 of the ramp segment 166 such that the flat segment 170 is substantially parallel and vertically offset from the base 118 by a first distance 'd1'.

Figure 6:
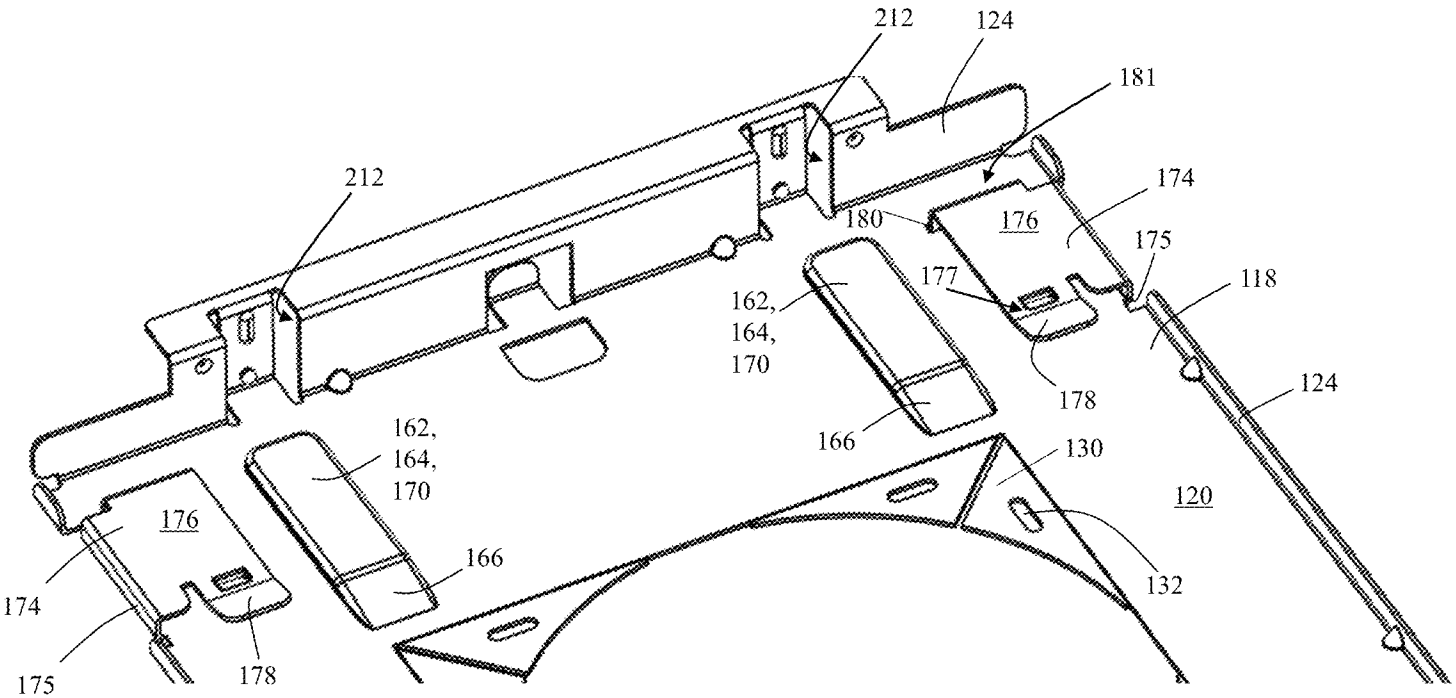
FIG. 6 is an enlarged view of a portion of the example configurable mounting frame illustrating example locking features of the example configurable mounting frame, in accordance with example embodiments of the present disclosure.

Additionally, the locking features 160 may include snap flanges 174 that integrally formed with the frame 102 and disposed adjacent the mounting pads 162. In particular, in the example embodiment illustrated in FIGS. 1-8, 10, and 12-13, each snap flange 174 may include a level segment 176 that is substantially parallel to and vertically offset from the base 118 by a second distance 'd2'. The second distance 'd2' by which the flat segment 170 of the mounting pads 162 is vertically offset from the base 118 may be larger than the first distance 'd1' such that a gap 179 (shown in FIG. 7) may be formed between a plane comprising the flat segment 170 of the mounting pads 162 and a plane comprising the level segment 176 of the snap flanges 174. Further, a side edge 175 of the level segment 176 of each snap flange 174 may be integrally coupled to or integrally formed with a side wall 124 of the frame 102. Furthermore, as illustrated in FIGS. 6, 7, and 8, each snap flange 174 may include a push segment 178 that extends angularly from a front edge 177 of the level segment 176 such that it forms an obtuse external angle 173 with the level segment 176. Additionally, the snap flange 176 may include a foot 180 that is substantially L-shaped and extends substantially perpendicular to the base 118 and the level segment 176 of the snap flange 174 from a back edge 181 of the snap flange 174. The foot 180 may extend through a slot that is formed in the base 118 and engages with the base 118. The foot 180 may be configured and coupled to the base 118 such that it allows the snap flange 174 to be flexible without being detached from the frame to release the electrical or electronics components that are locked to the frame 102. The snap flange 176 may further include a snap tab 182 that is cut and bent out from the level segment 176 such that the snap tab 182 extends angularly down towards the base 118 from the level segment 176.

Figure 11:
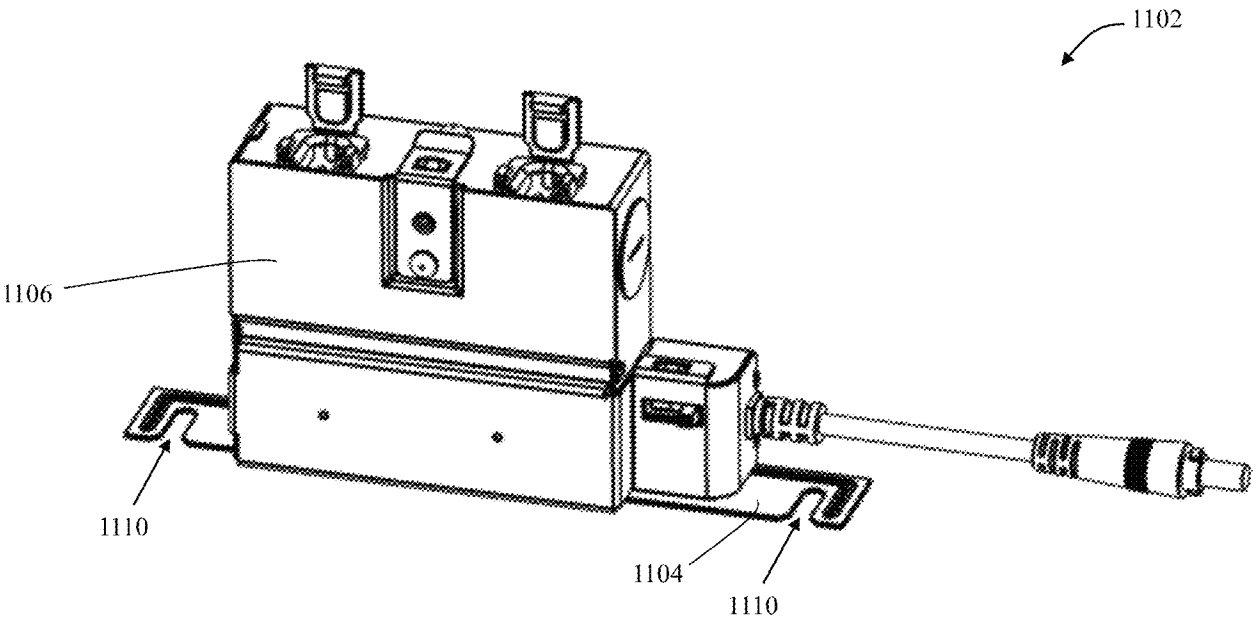
FIG. 11 illustrates a perspective view of an example junction box-driver assembly with mounting feet for removably coupling the junction box assembly to the example configurable mounting frame, in accordance with example embodiments of the present disclosure.
Figure 12:
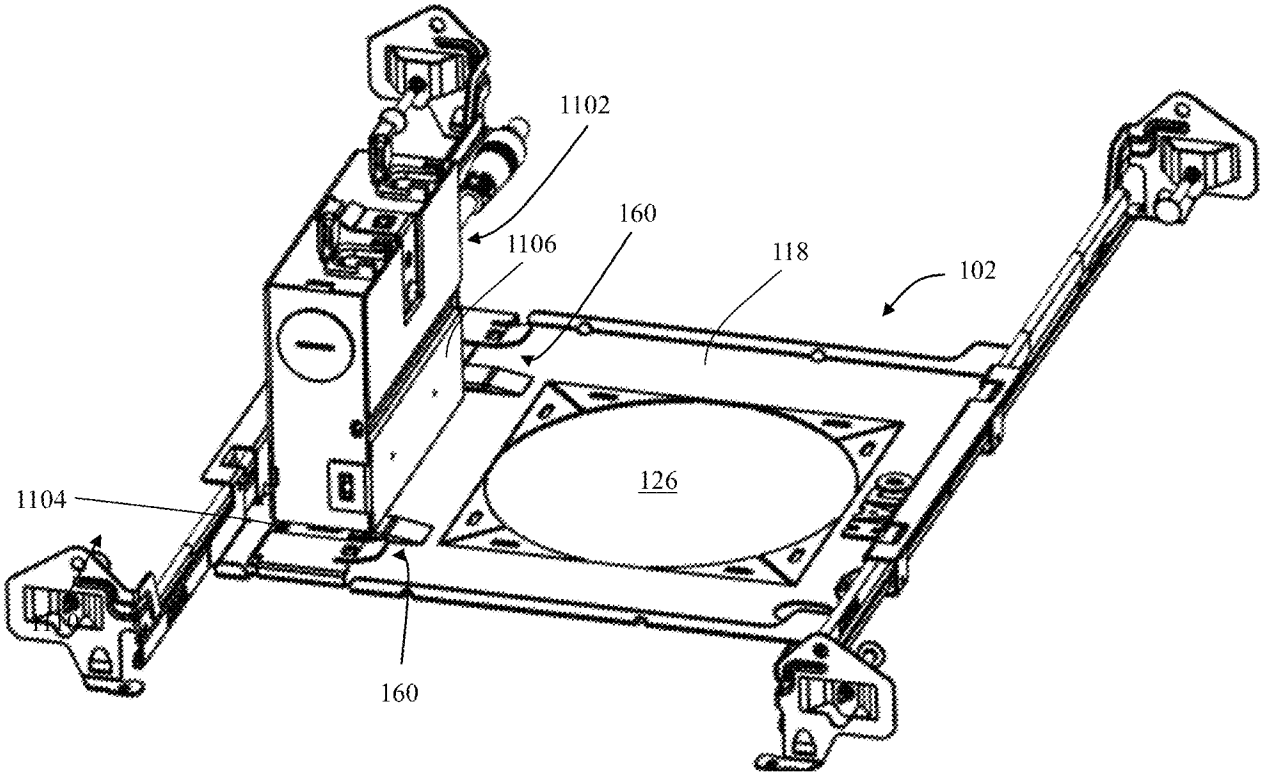
FIG. 12 illustrates a perspective view of the example configurable mounting frame with the example junction box-driver assembly coupled thereto using the mounting feet of the junction box assembly and the locking features of the example configurable mounting frame, in accordance with example embodiments of the present disclosure.
Figure 13:
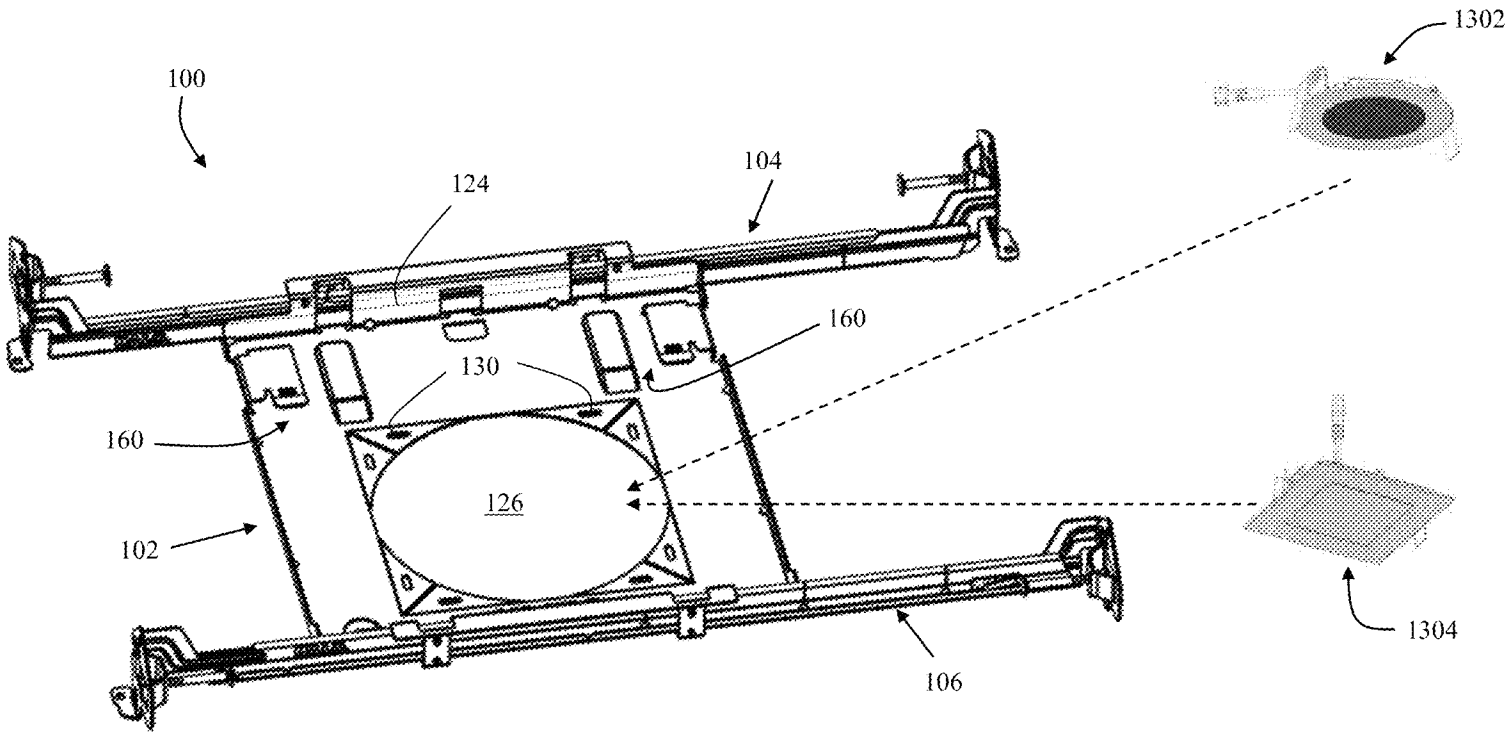
FIG. 13 illustrates the perspective view of the example luminaire mounting assembly of FIG. 1 with example lighting modules of different shapes that can be coupled to the example configurable mounting frame of the example luminaire mounting assembly, in accordance with example embodiments of the present disclosure.

The mounting tabs 162 and the snap flanges 174 may operate in concert to toollessly and removably couple the electrical and/or electronic component, such as a junction box-driver assembly 1102 to the frame 102. As illustrated in FIG. 11, an example junction box-driver assembly 1102 may include a mounting foot 1104 to which the junction box-driver 1106 is removably coupled. The junction box-driver assembly 1102 of FIG. 11 is described in greater detail in the U.S. patent application Ser. No. 16/290,414, that is filed concurrently herewith in the name of John Bowen and Jared Davis and entitled "Junction Box-Driver Assembly for Direct Mount Luminaires," the entire contents of which is hereby incorporated herein by reference. As illustrated in FIG. 12, the mounting foot 1104 may be a planar member that is configured to removably couple (e.g., releasably lock) the junction box-driver unit 1106 to the frame 102 by engaging with the locking features 160 of the frame 102.

In particular, a user (e.g., installer, end user, etc.) may insert the junction box-driver assembly 1102 (or any other appropriate electrical or electronic component) including the mounting foot 1106 through the fixture receiving opening 126 of the frame 102. The user may have to rotate and adjust the orientation of the junction box-driver assembly 1102 to insert it through the fixture receiving opening 126. Once the junction box-driver assembly 1102 is inserted through the fixture receiving opening 126 of the frame 102, the user may rotate and reorient the junction box-driver assembly 1102 such that the mounting foot 1106 of the junction box-driver assembly 1102 is substantially parallel to the base 118 of the frame 102. Then, using the ramp segment 166 of the mounting pads 162 as a guide, the user may push the junction box-driver assembly 1102 towards the flat segment 170 of the mounting pads 162 such that: (a) the mounting foot 1106 of the junction box-driver assembly 1102 is disposed in the gap 179 formed between a plane comprising the flat segment 170 of the mounting pads 162 and a plane comprising the level segment 176 of the snap flanges 174, and (b) the mounting foot 1106 of the junction box-driver assembly 1102 rests on the flat segments 170 of the mounting pads 162. The flat segments 170 of the mounting pads 162 may be configured to support and balance the mounting foot 1106 and the junction box-driver unit 1104 coupled thereto. The junction box-driver assembly 1102 may be further pushed along the flat segment 170 of the mounting pads 162 till: (a) the mounting foot 1106 engages the foot 180 of the snap flange 174 that extends substantially perpendicularly from the back edge 181 of the snap flanges 174, and (b) the snap tabs 182 of the snap flanges 174 snap into or engage the notches 1110 formed in the mounting foot 1106 to lock the mounting foot 1106 of the junction box-driver assembly 1102 therein, and thereby lock the junction box-driver assembly 1102 to the frame 102.

To release the junction box-driver assembly 1102 that is locked to the frame 102 using the locking features 160, the user may apply pressure on the push segments 178 of snap flanges 174 using the user's fingers to push the snap flanges 174 in a direction that is away from the base 118 of the frame 102 (e.g., upwards). Pushing the snap flanges 174 away from the base 118 may disengage the snap tabs 182 of the snap flanges 174 from the notches 1110 of the mounting foot 1104 of the junction box-driver assembly 1102, thereby allowing the mounting foot 1104 and the consequently the junction box-driver assembly 1102 to slide out from the flat segments 170 towards the ramp segments 166 of the mounting pads 162. Once the junction box-driver assembly 1102 is released and glided out as described above, the user may remove the junction box-driver assembly 1102, e.g., through the light receiving opening 126 of the frame 102.

As described above, the ability to toollessly and removably couple or releasably lock an electrical or electronic component such as the junction box-driver assembly 1102 to the frame 102 using the locking features 160 allows a user to easily install, remove, and replace the electrical or electronic component as needed in new construction or remodel applications where the frame 102 is already mounted in the finished ceiling. The electrical or electronic components, such as the junction box-driver assembly 1102 may also be coupled to the frame 102 using the locking features 160 prior to installing or mounting the frame 102 in the ceiling (or any other appropriate mounting surface). However, the ability to install, remove, and replace the electrical or electronic component from the frame 102 in new construction or remodel applications where the frame 102 is already mounted in the finished ceiling distinguishes the frame 102 of the present application from the conventional mounting frames where the electrical or electronic components have to be attached to the mounting frame prior to installing the mounting frame in ceiling.

Even though the present disclosure describes a locking feature that uses a snap lock mechanism for toolless locking of the electrical or electronic components to the frame, one of skill in the art can understand and appreciate that in other example embodiment, the locking features of the frame may be configured to use any other appropriate toolless locking mechanism to releasably lock electrical or electronic components such as a junction box assembly, driver assembly, junction box-driver assembly, etc., to the frame without departing from a broader scope of the present disclosure. Further, in some example embodiments, the frame 102 may include more locking features 160 disposed around the fixture receiving opening 126 of the frame 102 such that more than one electrical or electronic components can be attached to the frame 102 at the same time or the electrical or electronic components can be repositioned within the frame 102.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A configurable mounting frame comprising:

a base that comprises:

a light fixture receiving opening formed therein, the light fixture receiving opening having a first shape and configured to receive a first light fixture, wherein a shape of the first light fixture corresponds to the first shape of the light fixture receiving opening;

a breakaway panel disposed adjacent to the light fixture receiving opening, the breakaway panel being detachable from the base to change the light fixture receiving opening from the first shape to a second shape, wherein the light fixture receiving opening having the second shape is configured to receive a second light fixture, and wherein a shape of the second light fixture corresponds to the second shape of the light fixture receiving opening; and a locking feature comprising a mounting pad and a snap flange, the locking feature configured to releasably lock an electrical component to the configurable mounting frame; and a side wall that extends substantially perpendicular to the base from a perimeter of the base, wherein the locking feature is disposed on the base between the side wall and the light fixture receiving opening.

2. The configurable mounting frame of claim 1, wherein the breakaway panel is outlined by a slit along which the breakaway panel is detachable from the base.

3. The configurable mounting frame of claim 1, wherein the first shape is a circle and the second shape is a square.

4. The configurable mounting frame of claim 1, wherein the electrical component comprises a junction box assembly.

5. The configurable mounting frame of claim 1, wherein the electrical component comprises a driver assembly.

6. The configurable mounting frame of claim 1, wherein the electrical component comprises a junction box-driver assembly.

7. The configurable mounting frame of claim 1, wherein the side wall defines a hanger bar receiving slot configured to receive a hanger bar assembly therethrough to mount the configurable mounting frame.

8. A configurable mounting frame comprising:

a base that comprises:

a light fixture receiving opening formed therein, the light fixture receiving opening having a first shape and configured to receive a first light fixture, wherein a shape of the first light fixture is substantially similar to the first shape of the light fixture receiving opening; and a breakaway panel disposed adjacent to the light fixture receiving opening, the breakaway panel being detachable from the base to change the light fixture receiving opening from the first shape to a second shape, wherein the first shape is a circle and the second shape is a square;

wherein the light fixture receiving opening having the second shape is configured to receive a second light fixture, and wherein a shape of the second light fixture is substantially similar to the second shape of the light fixture receiving opening.

9. The configurable mounting frame of claim 8, further comprising: a locking feature configured to toollessly and releasably lock an electrical component to the configurable mounting frame.

10. The configurable mounting frame of claim 8, further comprising a side wall that extends substantially perpendicular to the base from a perimeter of the base, wherein the breakaway panel is disposed on the base between the side wall and the light fixture receiving opening.

11. The configurable mounting frame of claim 8, wherein the breakaway panel is outlined by a slit along which the breakaway panel is detachable from the base.

12. The configurable mounting frame of claim 9, wherein the electrical component comprises a junction box assembly.

13. The configurable mounting frame of claim 9, wherein the electrical component comprises a driver assembly.

14. The configurable mounting frame of claim 9, wherein the electrical component comprises a junction box-driver assembly.

15. A configurable mounting frame comprising:

a base that comprises:

a light fixture receiving opening formed therein, the light fixture receiving opening having a first shape and configured to receive a first light fixture, wherein a shape of the first light fixture is substantially similar to the first shape of the light fixture receiving opening;

a breakaway panel disposed adjacent to the light fixture receiving opening, the breakaway panel being detachable from the base to change the light fixture receiving opening from the first shape to a second shape, wherein the light fixture receiving opening having the second shape is configured to receive a second light fixture, and wherein a shape of the second light fixture is substantially similar to the second shape of the light fixture receiving opening, and wherein the first shape is a circle and the second shape is a square; and a locking feature that is configured to releasably lock an electrical component to the configurable mounting frame.

16. The configurable mounting frame of claim 14, wherein the breakaway panel is outlined by a slit along which the breakaway panel is detachable from the base.

* * * * *